US008366219B2

(12) United States Patent
Brown et al.

(10) Patent No.: US 8,366,219 B2
(45) Date of Patent: Feb. 5, 2013

(54) FOAM INSERTS FOR REFRIGERATOR CABINET

(75) Inventors: Andrew D. Brown, Anderson, SC (US); Steven Scott House, Anderson, SC (US); Michael Bayne, Easley, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 407 days.

(21) Appl. No.: 12/713,968

(22) Filed: Feb. 26, 2010

(65) Prior Publication Data

US 2010/0213805 A1 Aug. 26, 2010

Related U.S. Application Data

(60) Provisional application No. 61/155,577, filed on Feb. 26, 2009.

(51) Int. Cl.
*A47B 96/04* (2006.01)

(52) U.S. Cl. ..... 312/400; 312/406

(58) Field of Classification Search ..... 312/400–401, 312/406–406.1, 407–407.1; 62/440–441, 62/447

See application file for complete search history.

(56) References Cited

U.S. PATENT DOCUMENTS

| | | | | | |
|---|---|---|---|---|---|
| 2,639,592 | A * | 5/1953 | Philipp | 62/334 |
| 2,837,900 | A * | 6/1958 | Harle | 62/445 |
| 3,177,271 | A * | 4/1965 | Slayman | 264/46.5 |
| 3,601,463 | A * | 8/1971 | Watt | 312/406 |
| 3,966,283 | A * | 6/1976 | Puterbaugh | 312/406 |
| 4,765,696 | A | 8/1988 | Cordill et al. | |
| 4,771,532 | A | 9/1988 | Taylor, Jr. et al. | |
| 4,914,341 | A * | 4/1990 | Weaver et al. | 312/407 |
| 5,033,182 | A | 7/1991 | Winterheimer et al. | |
| 5,842,760 | A * | 12/1998 | Gatti et al. | 312/406 |
| 6,209,342 | B1 * | 4/2001 | Banicevic et al. | 62/443 |
| 6,290,314 | B1 | 9/2001 | Kim | |
| 2007/0104841 | A1 | 5/2007 | Min et al. | |
| 2007/0127229 | A1 | 6/2007 | Lee et al. | |
| 2010/0181883 | A1 * | 7/2010 | Kim et al. | 312/405 |

FOREIGN PATENT DOCUMENTS

| | | | |
|---|---|---|---|
| DE | 29814243 | | 11/1998 |
| JP | 02230077 | A * | 9/1990 |

* cited by examiner

*Primary Examiner* — Hanh V Tran
(74) *Attorney, Agent, or Firm* — Pearne & Gordon LLP

(57) ABSTRACT

A method of assembling a cabinet and an apparatus assembled according to the method are provided. The cabinet includes a shell with internal walls, a first compartment liner and a second compartment liner configured to be housed within the shell. The first compartment liner includes a first liner face and defines a first compartment. The second compartment liner includes a second liner face and defines a second compartment. The method includes the steps of positioning a pair of elongate supports between the first compartment liner and the second compartment liner such that the first liner face and the second liner face are adjacent one another and spaced apart.

21 Claims, 6 Drawing Sheets

FOAM INSERTS FOR REFRIGERATOR CABINET

CROSS-REFERENCE TO RELATED APPLICATIONS

This application claims the benefit of U.S. Provisional Application No. 61/155,577, filed Feb. 26, 2009, the entire disclosure of which is hereby incorporated herein by reference.

TECHNICAL FIELD

The disclosure relates to a method of manufacturing a cabinet structure and an apparatus manufactured using such a method and, more particularly, a method of spacing apart compartment liners in a cabinet structure using a set of supports and an apparatus manufactured using such a method.

BACKGROUND

A cabinet structure, such as a refrigerator, is often incorporated with insulating layers in order to create one or more temperature-controlled spaces. Forming insulating layers that are qualitatively uniform throughout is difficult because the insulating material must be distributed about the interior components within the cabinet structure. Moreover, the formation of insulating layers can also cause defects in the cabinet structure, such as deformations to the shell. Thus, there is a need for improved methods of forming insulating layers in a cabinet structure.

SUMMARY

The following presents a simplified summary of the disclosure in order to provide a basic understanding of some example aspects described in the detailed description.

In one example aspect, a cabinet includes a shell, a first compartment liner, a second compartment liner and a pair of elongate supports. The first compartment liner defines a first compartment and includes a first liner face. The second compartment liner defines a second compartment and includes a second liner face. The first and second compartment liners are housed within the shell. The first compartment liner and the second compartment liner are mounted within the shell with the first liner face and the second liner face adjacent one another. The first and second liner faces are spaced apart by the pair of elongate supports located therebetween.

In another example aspect, the elongate supports are arranged at substantially opposite and peripheral locations between the first and second liner faces so as to define an internal gap between the elongate supports.

In yet another example aspect, the elongate supports extend in fore and aft directions with respect to the cabinet.

In yet another example aspect, at least one of the elongate supports includes a first channel extending therethrough and configured to establish fluid communication between the first compartment and the second compartment.

In yet another example aspect, a cross-sectional area of the first channel becomes gradually larger in a direction of fluid flow.

In yet another example aspect, at least one of the elongate supports includes a second channel extending therethrough and configured to establish fluid communication between the first compartment and the second compartment.

In yet another example aspect, a first direction of fluid flow in the first channel and a second direction of fluid flow in the second channel are opposite one another.

In yet another example aspect, the elongate supports are made from expanded polystyrene foam.

In yet another example aspect, the shell includes interior walls. The first compartment liner and the second compartment liner are dimensioned and positioned within the shell to form at least an external gap between the interior walls and the first and second compartment liners. The external gap and the internal gap are substantially filled with foam.

In yet another example aspect, the elongate supports are substantially engulfed in foam.

In yet another example aspect, the foam is made from polyurethane insulating foam.

In yet another example aspect, the elongate supports include a left-hand side support and a right-hand side support that substantially mirror one another.

In yet another example aspect, the first liner face and the second liner face include a first protruding area and a second protruding area respectively. Each of the elongate supports includes a first contact surface and a second contact surface. The first contact surface includes a first recess portion configured to mate with a first section on a perimeter of the first protruding area. The second contact surface includes a second recess portion configured to mate with a second section on a perimeter of the second protruding area.

In yet another example aspect, the first recess portion and the first section are shaped such that movement of the first compartment liner relative to the elongate supports is configured to be restricted along both fore and aft directions, and the second recess portion and the second section are shaped such that movement of the second compartment relative to the elongate supports is configured to be restricted along only one of the fore and aft directions.

In yet another example aspect, the first compartment liner is configured to be positioned above the second compartment liner inside the shell.

In yet another example aspect, a cross-sectional area of the elongate supports along a transverse plane gradually tapers from the first contact surface to the second contact surface.

In yet another example aspect, a method of assembling a cabinet is provided. The cabinet includes a shell with interior walls, a first compartment liner and a second compartment liner housed within the shell. The first compartment liner includes a first liner face and defines a first compartment. The second compartment liner includes a second liner face and defines a second compartment. The method including the steps of positioning a pair of elongate supports between the first compartment liner and the second compartment liner such that the first liner face and the second liner face are adjacent one another and spaced apart.

In yet another example aspect, the elongate supports are arranged at substantially opposite and peripheral locations between the first and second liner faces so as to define an internal gap between the elongate supports.

In yet another example aspect, the method further includes the step of positioning the first compartment liner and the second compartment liner within the shell such that at least one external gap is formed between the compartment liners and the interior walls.

In yet another example aspect, the method further includes the step of channeling a flow of foam into the cabinet so as to substantially fill the internal gap and the external gap where the flow of foam in the internal gap is substantially separated from the flow of foam in the external gap by the elongate supports.

In yet another example aspect, the method further includes the steps of fastening the elongate supports to one of the first outer face of first compartment liner and the second outer face of the second compartment liner, and inserting the first compartment liner and the second compartment liner alternately into the shell.

In yet another example aspect, the method further includes the step of positioning the elongate supports in fore and aft directions with respect to the cabinet.

BRIEF DESCRIPTION OF THE DRAWINGS

These and other aspects are better understood when the following detailed description is read with reference to the accompanying drawings, in which.

DETAILED DESCRIPTION

Figure 1:
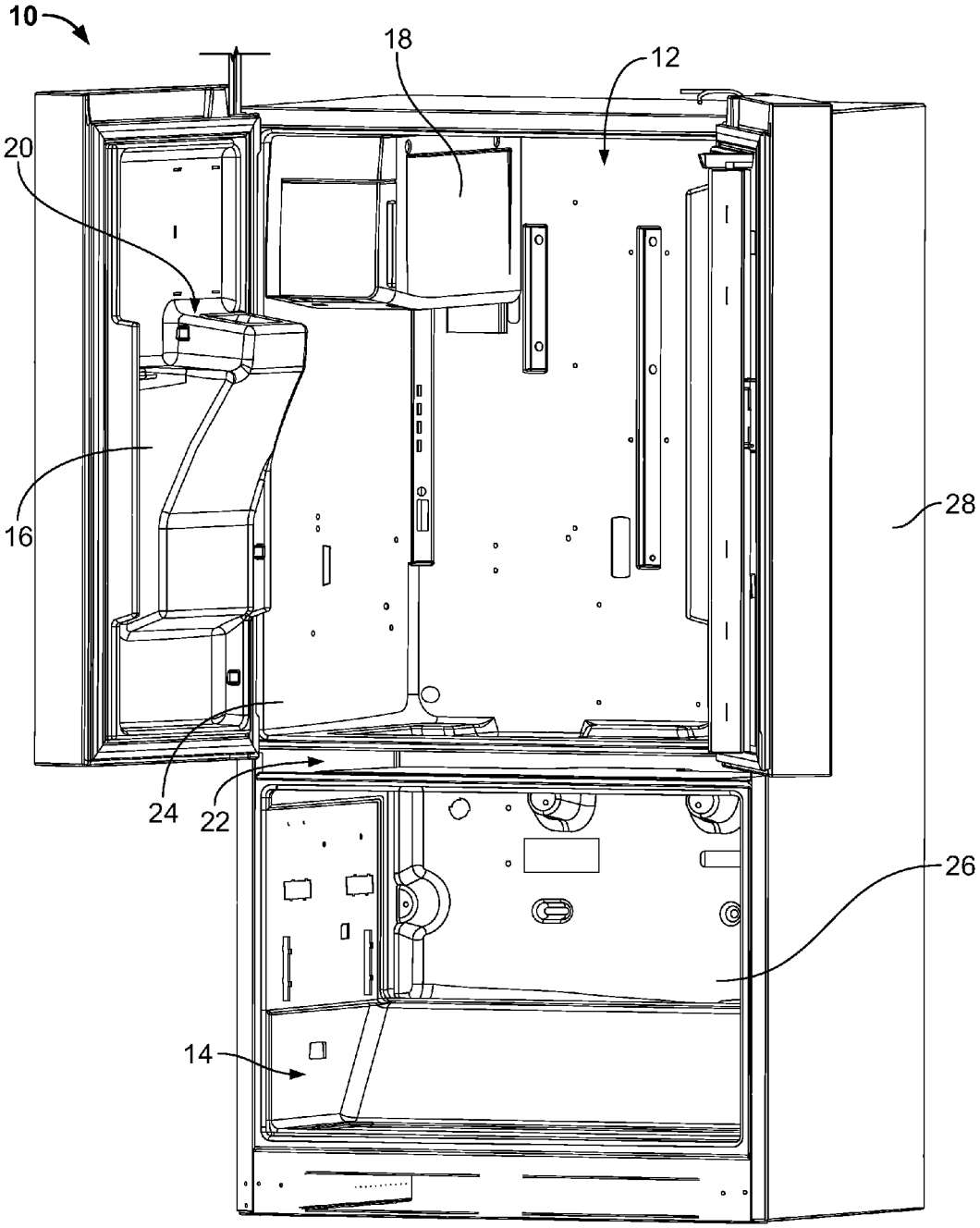
FIG. 1 is a perspective view of an example cabinet structure in which an example set of elongate supports can be inserted.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example embodiment of a cabinet 10 constructed using the method described herein is shown. While the cabinet 10 shown in FIG. 1 is an appliance and, more specifically, a refrigerator, the cabinet 10 can also be any other cabinet-like structure that may provide storage space and may include a temperature-controlled environment, such as a freezer, an ice container, a vending machine etc. In the present embodiment, the refrigerator is of a bottom-mount type with doors, and includes a first compartment 12 (e.g., a fresh-food compartment) above a second compartment 14 (e.g., a freezer compartment), an ice dispenser 16, an ice chamber 18 and an ice chute 20. However, refrigerators with other types of configuration for the freezer compartment, such as top-mount or side-by-side mount, are also contemplated. The compartments 12, 14 are separated by a mullion section 22 and are defined by compartment liners 24, 26 which are inserted into a shell 28 of the refrigerator.

Figure 2:
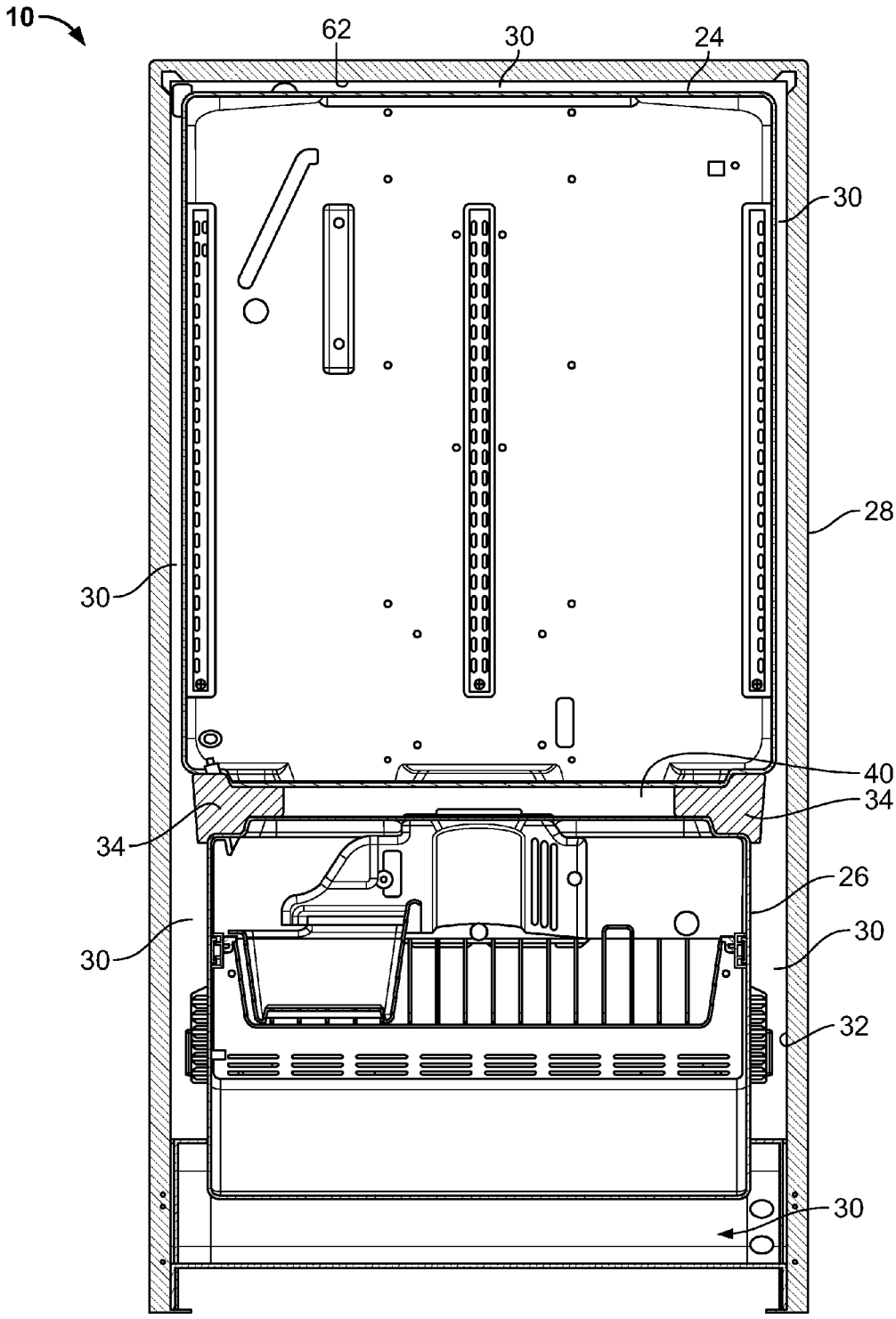
FIG. 2 is a front view of a shell of the cabinet structure with a first compartment liner and a second compartment liner mounted therein.
Figure 3:
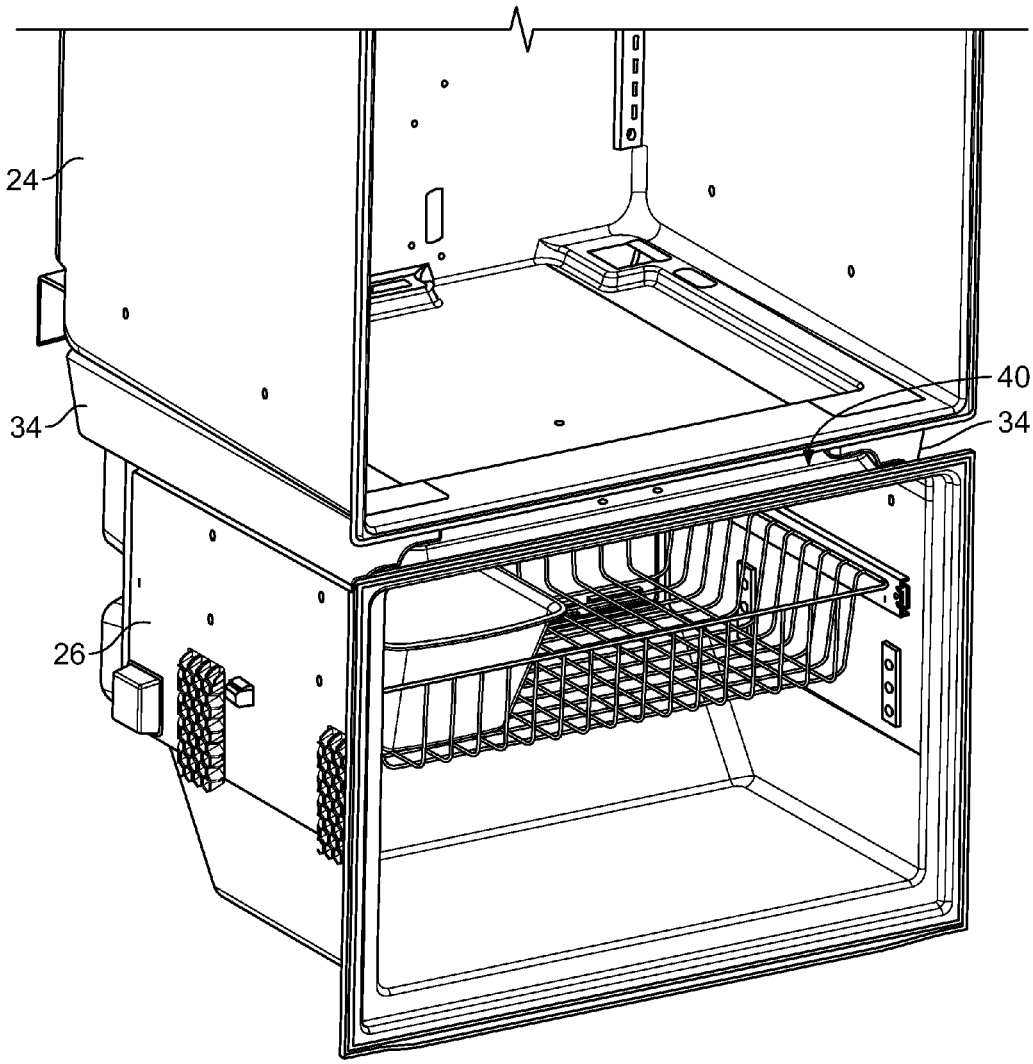
FIG. 3 is a perspective view of the first compartment liner and the second compartment liner separated by the elongate supports.

Specifically, as shown in FIG. 2, the first compartment 12 is defined by a first compartment liner 24 while the second compartment 14 is defined by a second compartment liner 26. As shown, the first and second compartment liners 24, 26 are separately molded components but may, for example, be parts of a single molded component. The compartment liners 24, 26 are dimensioned and positioned such that, when inserted within the shell 28, certain external gaps 30 that are to be filled with insulating material, such as foam, exist between an interior wall 32 of the shell 28 and a side of the compartment liner 24 or 26. Depending on the arrangement of the compartment liner 24 or 26, the external gaps 30 may be formed at the top, bottom or side of the compartment liner 24 or 26. As shown in FIGS. 2-3, the first compartment liner 24 and the second compartment liner 26 are also spaced apart from one another inside the shell 28 by placing a set of beam-like, elongate supports or inserts 34 between the two compartment liners 24, 26 thus forming the mullion section 22 (FIG. 1). While the present embodiment includes two elongate supports 34, it may be possible to use three or more elongate supports to space the compartment liners 24, 26 apart.

Figure 4:
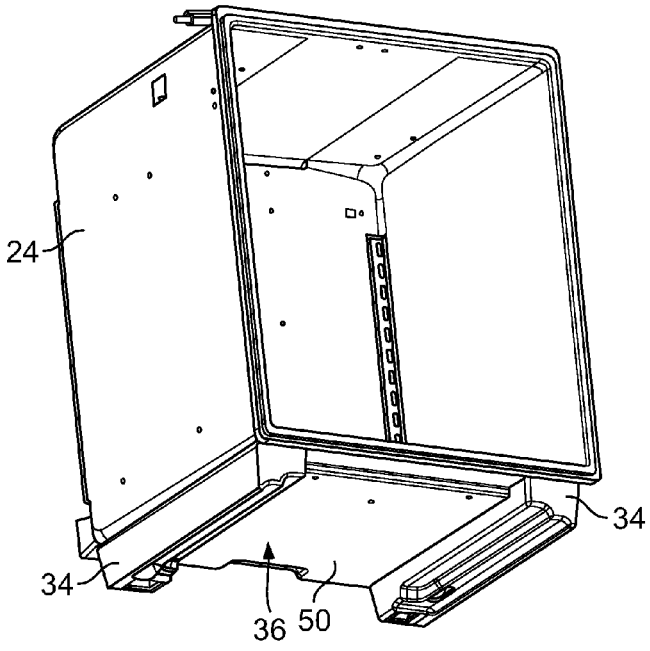
FIG. 4 is a bottom perspective view of the first compartment liner with the elongate supports fastened thereto.
Figure 5:
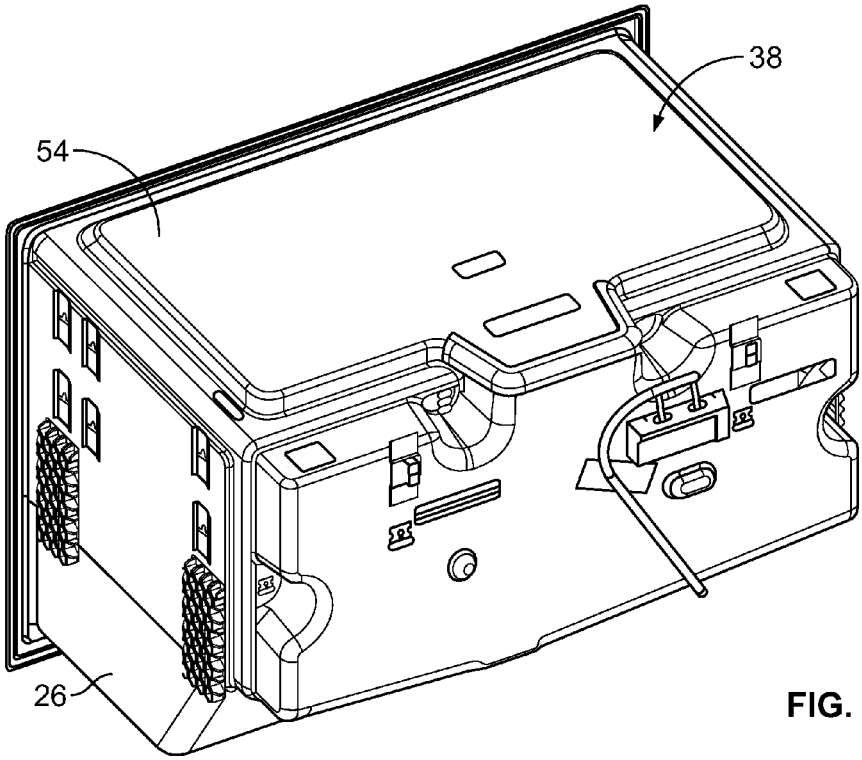
FIG. 5 is a top perspective view of the second compartment liner.

As shown in FIGS. 4-5, the first compartment liner 24 includes a first liner face 36 and the second compartment liner 26 includes a second liner face 38. The first liner face 36 and the second liner face 38 may be substantially similar in dimensions as in the present embodiment. The first liner face 36 and the second liner face 38 are arranged to be adjacent and face one another when the compartment liners 24, 26 are arranged inside the shell 28. The elongate supports 34 thereby create an internal gap 40 between the compartment liners 24, 26 that is to be filled with insulating material to become the mullion section 22. The orientation of the internal and external gaps 40, 30 may differ depending on the arrangement of the compartment liners 24, 26. For example, the internal gap 40 would be oriented horizontally if the compartment liners 24, 26 are arranged in a top-and-bottom fashion. The internal gap 40 would be oriented vertically if the compartment liners 24, 26 are arranged in a side-by-side fashion. The external gaps 30 may be vertical and/or horizontal depending on where the external gaps 30 are created by the arrangement of the compartment liners 24, 26 relative to the shell 28. For example, it may be possible to place a compartment liner 24 or 26 in the shell 28 so close to the interior wall 32 that no gap exists therebetween. In this embodiment where the cabinet 10 adopts a top-and-bottom arrangement of the compartment liners 24, 26, the internal gap 40 is oriented horizontally while the external gaps 30 are formed vertically and horizontally around the exterior of the compartment liners 24, 26.

The elongate supports 34 may be fastened to one of the first and second liner faces 36, 38 through means known in the art such as glue, screws, etc. As shown in FIG. 4, the elongate supports 34 may be positioned so as to oppose one another at substantially peripheral locations between the first and second liner faces 36, 38. Moreover, the elongate supports 34 may be dimensioned so as to extend substantially across an entire side of the liner face 36, 38. Such a configuration would allow the elongate supports 34 to act as a boundary between the external gap 30 and internal gap 40 when the first compartment liner 24 and the second compartment liner 26 are inserted within the shell 28. The elongate supports 34 may be fastened to extend in fore and aft directions with respect to the cabinet 10 in that the elongate supports 34 extend longitudinally between a door and the rear of the cabinet 10 as shown in FIG. 3.

Figure 6A:
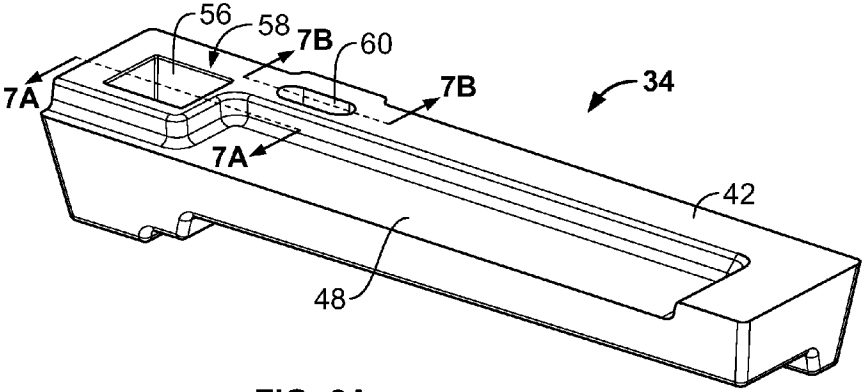
FIG. 6A is a top perspective view of the right-hand side elongate support.
Figure 6B:
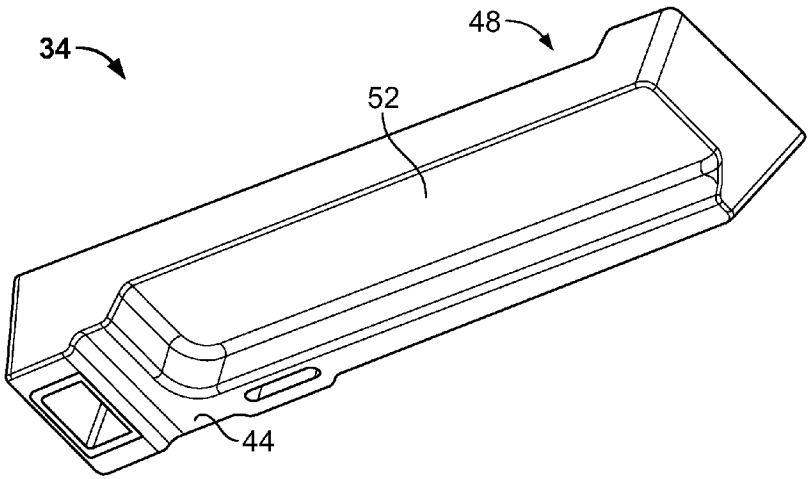
FIG. 6B is a bottom perspective view of the right-hand side elongate support.

As shown in FIG. 4, the pair of elongate supports 34 may substantially mirror one another so as to include a left-hand side version and a right-hand side version. As shown in FIGS. 6A-6B, each of the elongate supports 34 includes a first contact surface 42 that may be configured to contact the first liner face 36 and a second contact surface 44 that may be configured to contact the second liner face 38. As shown in FIG. 4, the first liner face 36 may include a first protruding area 50 and each of the first contact surfaces 42 may include a first recess portion 48 that corresponds partially in shape to a perimeter of the first protruding area 50 such that the first protruding area 50 may mate with or be keyed with the first recess portion 48. For example, the first protruding area 50 may have a substantially rectangular shape, and each of the left-hand first recess portion 48 and the right-hand recess portion 48 may be shaped to mate with a portion of the first protruding area 50, for example, a side of the first protruding area 50 and its two adjacent corners. Once the first protruding area 50 and the first recess portions 48 reach a mated or keyed position, the elongate supports 34 are prevented from moving in fore and aft directions with respect to the first compartment liner 24. The edges and corners of the first protruding area 50 and the first recess portion 48 may have certain angled and/or rounded configurations to allow the elongate supports 34 to become securely positioned with respect to the first liner face 36 in a sliding fashion with ease.

Once the elongate supports 34 are fastened to the first compartment liner 24, the first compartment liner 24 may be inserted into the shell 28. The shell 28 may include securing means well known in the art, such as flanges, rails, hooks, tabs or the like, to allow the first compartment 24 to be secured to the shell 28.

The second contact surface 44 and the second compartment liner 26 show an alternative manner in which a compartment liner can contact a contact surface. As shown in FIGS. 4-5 and 6B, the second contact surface 44 may include a second recess portion 52 that allows the second compartment liner 26 to be movable with respect to the elongate supports 34 in a mated position. Specifically, as shown in FIG. 6B, the second recess portion 52 may be open-ended on one longitudinal end such that a second protruding area 54 on the second liner face 38 that is substantially rectangular in shape may slide in and out of the second recess portion 52 in order to move in and out of a mated or keyed position. Thus, when inserting the second compartment liner 26 in the shell 28, the elongate supports 34, which are already fastened to the first compartment liner 24, can be approached in one of the fore and aft directions by the second compartment liner 26. The shell 28 may include securing means well known in the art, such as rails, flanges, hooks, tabs or the like, to allow the second compartment 14 to be mounted inside the shell 28. The second contact surface 44 may or may not need to be fastened to the second compartment liner 26.

While the present embodiment is shown to have protruding areas on the liner faces and recess portions on the contact surface of the elongate supports, it is noted that, instead, the protruding area may be provided on the contact surface and that liner face may be provided with the recess portion.

Figure 7A:
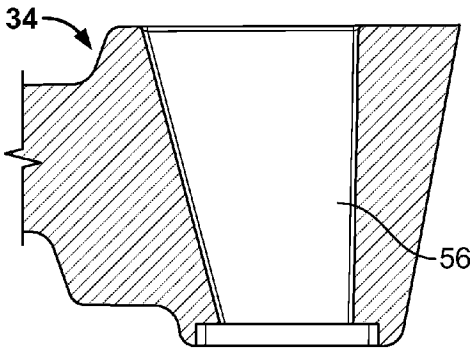
FIG. 7A is a cross-sectional view across a first channel in the elongate support.
Figure 7B:
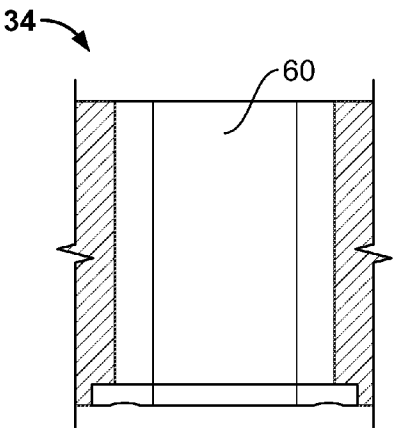
FIG. 7B is a cross-sectional view across a second channel in the elongate support.

As shown in FIGS. 6A-6B, the elongate supports 34 may be provided with means to allow fluid communication between the compartments 12, 14. The elongate supports 34 may include a first channel 56 extending through the elongate support 34 from the first contact surface 42 to the second contact surface 44. The first channel 56 allows fluid communication between the first compartment 12 and the second compartment 14. In this manner, as shown in the assembled states of FIGS. 3-5, a first stream of air in one temperature-controlled environment in the first compartment 12 may be allowed to move to another temperature-controlled environment in the second compartment 14 or vice versa. For example, the first channel 56 may serve as a return air duct and be used to allow the warmer air in the fresh-food compartment to be cooled by re-circulating the air to an evaporator in the freezer compartment in order to be sent back to the fresh-food compartment. As shown in FIG. 7A, the first channel 56 may become gradually wider from the second contact surface 44 to the first contact surface 42 and an opening 58 on the first contact surface 42 may be designed to be as large as possible. Such a configuration is intended to minimize the air resistance for the return air by gradually increasing the cross-sectional area in the direction of air flow. In addition to the first channel 56, the elongate supports 34 may also include a second channel 60, as shown in FIGS. 6A-6B and 7B, similarly extending through the elongate support 34 from the first contact surface 42 to the second contact surface 44. The second channel 60 may be provided to allow a second stream of air from one temperature-controlled environment in the first compartment 12 to move to another temperature-controlled environment in the second compartment 14. For example, the second channel 60 may direct cold air from the freezer compartment to a limited portion of the fresh-food compartment, such as a drawer providing a temperature-controlled environment that is distinct from the temperature-controlled environment of the fresh-food compartment. Thus, the direction of air flow through the first and second channels 56, 60 need not be the same. The second channel 60 may be narrower than the first channel 56 and thus may only allow a smaller volume of air flow to travel therethrough. The compartments 12, 14 may include an air-circulating means, such as a fan, to generate movements of air in a desired manner.

The elongate supports 34 are formed through molding and can be made of material distinct from or similar to foam such as expanded polystyrene foam. The cross sectional area of the elongate supports 34 along a transverse plane may be tapered in order to facilitate removal of the elongate support 34 from a mold although other shapes may also provide such capabilities.

Expanded polystyrene foam (EPF), sometimes referred to using the misnomer trademark "Styrofoam™", is a plastic material composed of individual detached cells of low density polystyrene. EPF can be made by expanding polystyrene beads with a hot gas and bonding the beads together under pressure in a block or shape mold. EPF can be molded into a variety of shapes and offers thermal insulation, strength with low weight, and coverage with few heat loss paths. Instead of EPF, different types of materials that offer desired characteristics such as low thermal conductivity or ease of molding, such as other types of cellular plastics, may also be used to make the elongate supports 34.

Figure 8:
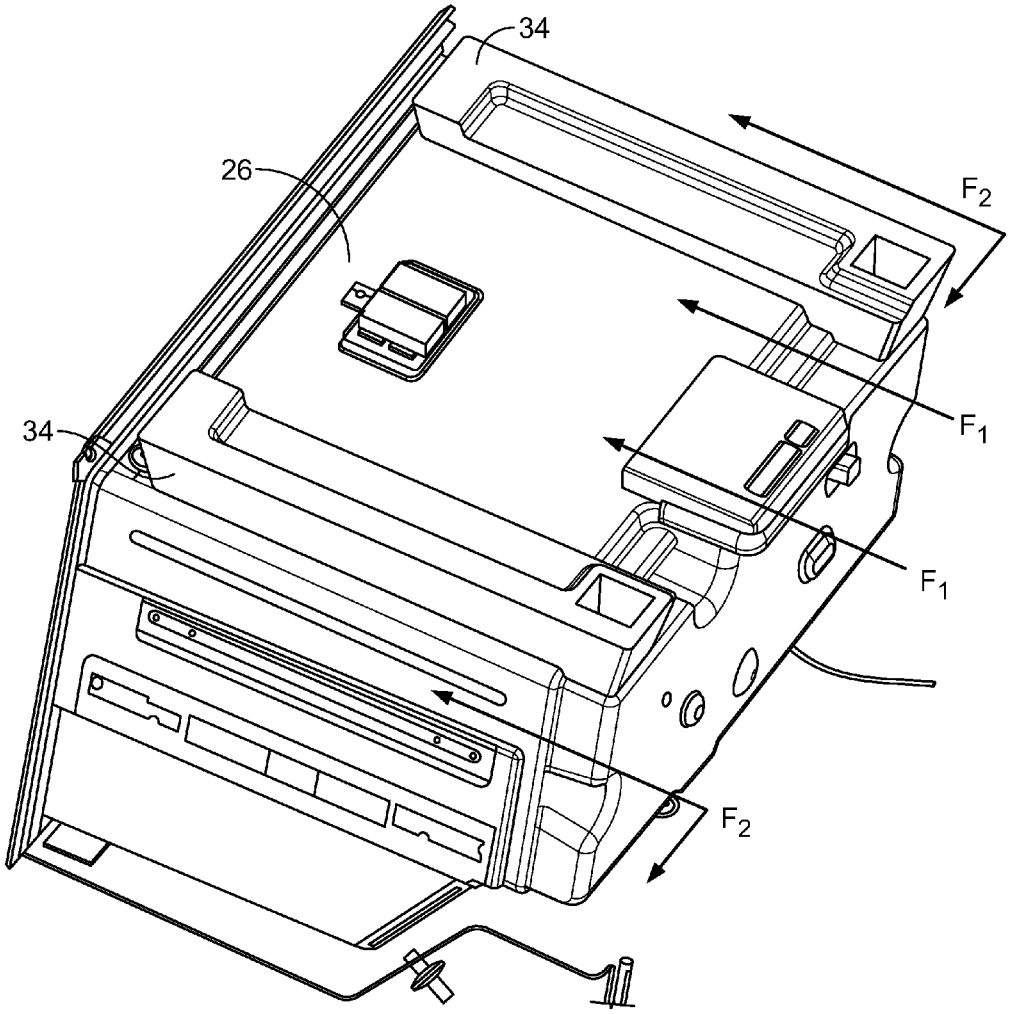
FIG. 8 shows examples of flows of insulating material with respect to the second compartment liner.

Once the compartment liners 24, 26 are secured inside the shell 28, the cabinet 10 may be provided with a molten flow of foam to permeate and fill the internal gap 40 between the compartment liners 24, 26 and external gaps 30 around the compartment liners 24, 26 and thereby form insulating layers as shown in FIG. 8. The foam may be of various types of material known in the art as offering qualities, such as low thermal conductivity, lightness of weight, moldability, etc., and may be polyurethane insulating foam, expanded polystyrene foam, or the like. While not illustrated in the figures, the shell 28 may be temporarily provided with panels or molds for directing the flow of foam and for determining a final shape of the foam. The supply of foam may originate from various parts of the cabinet 10, such as the front or rear of the cabinet 10. In the present embodiment, the flow of foam is supplied from the rear of the cabinet 10 to fill the internal gap 40 between the compartment liners 24, 26 and the external gaps 30 to the sides of the compartment liners 24, 26. The flow of foam for filling the internal gap 40 and the external gaps 30 may be provided separately, for example, through a flow F1 for the internal gap 40 and a flow F2 for the external gaps 30.

The elongate supports 34 may become engulfed in foam when the internal gap 40 is filled. Moreover, the gaps between the first compartment liner 24 and the top interior wall of the shell 28 and between the second compartment liner 26 and the bottom interior wall of the shell 28 may be filled by additional flows of foam. The presence of the elongate supports 34 acts as a boundary between the internal gap 40 and the external gaps 30 such that the flows of foam for the distinct gaps 30, 40 are substantially kept apart. The elongate supports 34 thus help form a more uniform distribution of insulating material within the gaps 30, 40. The mullion section 22 formed at the internal gap 40 can become more energy efficient and, as a result, may be able to reduce heat exchange that may arise from a heat gradient between the temperature-controlled environments of the compartments. Moreover, the elongate supports 34 can also help channel the flow of foam F1, F2 toward a desired direction depending on how the elongate supports 34 are arranged. For example, if the elongate supports 34 are arranged in fore and aft directions, the flow of foam F1, F2 can be channeled from the rear toward the front of the cabinet 10 or vice versa and the foam is less likely to flow in undesired directions.

Furthermore, the elongate supports 34 limit the extent of shrinkage of the foam in the mullion section 22 from propagating to the external gaps. The shrinkage which occurs during the curing of the foam can form concavities or sinks on the shell 28 that can make the appearance of the cabinet 10 unattractive. The elongate supports 34 can limit the curing of the foam in the internal gap 40 or mullion section 22 from further spreading to external gaps 30 near the mullion section 22.

It will be apparent to those skilled in the art that various modifications and variations can be made without departing from the spirit and scope of the claimed invention.

What is claimed is:

1. A cabinet including:

a shell;

a first compartment liner defining a first compartment and including a first liner face;

a second compartment liner defining a second compartment and including a second liner face, the first and second compartment liners housed within the shell; and a pair of elongate supports, wherein the first compartment liner and the second compartment liner are mounted within the shell with the first liner face and the second liner face adjacent one another, the pair of elongate supports located between and in contact with the first and second liner faces, wherein at least one of the elongate supports includes a first channel extending therethrough and configured to establish fluid communication between the first compartment and the second compartment.

2. The cabinet of claim 1, wherein the elongate supports are arranged at substantially opposite and peripheral locations between the first and second liner faces so as to define an internal gap between the elongate supports.

3. The cabinet of claim 1, wherein the elongate supports extend in fore and aft directions with respect to the cabinet.

4. The cabinet of claim 1, wherein a cross-sectional area of the first channel becomes gradually larger in a direction of fluid flow.

5. The cabinet of claim 1, wherein at least one of the elongate supports includes a second channel extending therethrough and configured to establish fluid communication between the first compartment and the second compartment.

6. The cabinet of claim 5, wherein a first direction of fluid flow in the first channel and a second direction of fluid flow in the second channel are opposite one another.

7. The cabinet of claim 1, wherein the elongate supports are made from expanded polystyrene foam.

8. The cabinet of claim 2, wherein the shell includes interior walls, the first compartment liner and the second compartment liner are dimensioned and positioned within the shell to form at least an external gap between the interior walls and the first and second compartment liners, the external gap and the internal gap being substantially filled with foam.

9. The cabinet of claim 8, wherein the elongate supports are substantially engulfed in foam.

10. The cabinet of claim 8, wherein the foam is made from polyurethane insulating foam.

11. The cabinet of claim 1, wherein the elongate supports include a left-hand side support and a right-hand side support that substantially mirror one another.

12. The cabinet of claim 1, wherein the first liner face and the second liner face include a first protruding area and a second protruding area respectively, each of the elongate supports includes a first contact surface and a second contact surface, the first contact surface includes a first recess portion configured to mate with a first section on a perimeter of the first protruding area, the second contact surface includes a second recess portion configured to mate with a second section on a perimeter of the second protruding area.

13. The cabinet of claim 12, wherein the first recess portion and the first section are shaped such that movement of the first compartment liner relative to the elongate supports is configured to be restricted along both fore and aft directions, and the second recess portion and the second section are shaped such that movement of the second compartment relative to the elongate supports is configured to be restricted along only one of the fore and aft directions.

14. The cabinet of claim 12, wherein the first compartment liner is configured to be positioned above the second compartment liner inside the shell.

15. The cabinet of claim 12, wherein a cross-sectional area of the elongate supports along a transverse plane gradually tapers from the first contact surface to the second contact surface.

16. A method of assembling a cabinet, the cabinet including a shell with interior walls, a first compartment liner and a second compartment liner housed within the shell, the first compartment liner including a first liner face and defining a first compartment, and the second compartment liner including a second liner face and defining a second compartment, the method including the steps of:

positioning a pair of elongate supports between the first liner face and the second liner face such that the first liner face and the second liner face are adjacent one another and spaced apart in contact with the elongate supports, at least one of the elongate supports including a channel extending therethrough and configured to establish fluid communication between the first compartment and the second compartment.

17. The method of claim 16, the elongate supports being arranged at substantially opposite and peripheral locations between the first and second liner faces so as to define an internal gap between the elongate supports.

18. The method of claim 17, further including the step of positioning the first compartment liner and the second compartment liner within the shell such that at least one external gap is formed between the compartment liners and the interior walls.

19. The method of claim 18, further including the step of channeling a flow of foam into the cabinet so as to substantially fill the internal gap and the external gap, the flow of foam in the internal gap substantially separated from the flow of foam in the external gap by the elongate supports.

20. The method of claim 17, further including the steps of fastening the elongate supports to one of the first outer face of first compartment liner and the second outer face of the second compartment liner, and inserting the first compartment liner and the second compartment liner alternately into the shell.

21. The method of claim 16, further including the step of positioning the elongate supports in fore and aft directions with respect to the cabinet.

* * * * *